US005829693A

United States Patent [19]

Schenk et al.

[11] Patent Number: 5,829,693

[45] Date of Patent: Nov. 3, 1998

[54] DEVICE FOR HOLDING STANDARD CAST GRATES OF EXISTING PARTITIONS FRAMES IN TUBE MILLS

[75] Inventors: Albert Schenk, Stavelot; Ghislain Bekaert, Enghien; Thierry Hermans, Meux La Bruyère, all of Belgium

[73] Assignee: Slegten Societe Anonyme, Louvain-La-Neuve, Belgium

[21] Appl. No.: 750,992

[22] PCT Filed: Jun. 16, 1995

[86] PCT No.: PCT/BE95/00056

§ 371 Date: Jun. 10, 1997

§ 102(e) Date: Jun. 10, 1997

[87] PCT Pub. No.: WO96/00127

PCT Pub. Date: Jan. 4, 1996

[30] Foreign Application Priority Data

Jun. 24, 1994 [BE] Belgium ..... 9400603

[51] Int. Cl.[6] ..... B02C 17/18

[52] U.S. Cl. ..... 241/72; 241/301

[58] Field of Search ..... 241/72, 171, 179, 241/DIG. 30, 299, 301

[56] References Cited

U.S. PATENT DOCUMENTS 5,016,826 5/1991 Michelsen et al. ..... 241/72

FOREIGN PATENT DOCUMENTS 0380952 8/1990 European Pat. Off. .
2122251 8/1972 France .
2345213 10/1977 France .
WO94/09906 5/1994 WIPO .

*Primary Examiner*—Mark Rosenbaum
*Attorney, Agent, or Firm*—Jacobson, Price, Holman & Stern, PLLC

[57] ABSTRACT

A device for holding the grates or backside plates of a partition in a tube mill, the partition being made of a frame that is flame cut or cast, in steel or iron. The frame is provided with anchor holes. The holding device is made of a perforated plate held on the partition frame, and is perpendicular to the mill axis, the perforated plate being provided with anchor holes for the grates or backside plates, the holes being, for a given diameter, always identically positioned so that for the given diameter, the same grates or backside plates are always used irrespective of the shape of the partition frame.

5 Claims, 4 Drawing Sheets

DEVICE FOR HOLDING STANDARD CAST GRATES OF EXISTING PARTITIONS FRAMES IN TUBE MILLS

SUBJECT OF THE INVENTION

The present invention relates to tube mills with grinding balls or similar grinding bodies.

These tube mills work either in dry process or in wet process and are used, for instance, for the grinding of cement.

The subject of the present invention relates, more particularly, to a device for holding grates in cast steel on existing partitions frames of partitions.

STATE OF THE ART

In a tube mill, a partition fulfils one of the following aims: either it separates two chambers of the mill by keeping the ball load in the chamber upwards while making possible for the material and the air of ventilation to go through it from the chamber upwards towards the chamber downwards, or it creates a free space between the ball load of the grinding chamber upwards and the outlet trunnion, space through which the ground material and the air could pass in order to reach the outlet trunion and then leave the tube mill.

The outlet partition also protects the outlet bottom from the wear and the impacts caused by the movements of the material and the ball load.

The construction of a partition is characterised by a frame that supports grates and, possibly, backside plates.

The frame is made of a structure—in cast steel or in mechanically joined and/or welded rolled steel—which stands perpendicularly to the mill axis and which, in the case of an outlet partition, rests on the mill bottom. Lifters made of radial blades are welded on that structure. Through the rotation of the mill, they lift the material that is within the lower part of the free space. The lifted material will then fall on a discharge cone or any other mechanical construction able to divert the said material either towards another mill chamber or towards the mill trunnion through which the material leaves the mill. These lifting blades contribute to hold the grates and in the case of an intermediate partition, the backside plates.

Through bolts link the frame to the mill shell.

Grates rest on the frame and are attached to it through bolts. Patent FR-A-2 345 213 (Polysius AG) is an example of such a system: the two "carrying discs" are parts of the frame as their name "carrying" indicates. The grates (plaques a fente) and the backside plates are directly attached to the said discs.

Similarly, in patent WO-A-94 09906 (Slegten s.a.), the grates are directly attached to the frame (framework elements).

Tightening the grates peripheral rings is always unproblematic since one keeps access to the bolts through the centre of the partition. If the centre of the partition remains open, tightening the grates central ring is also easy: the bolt nuts remain accessible as long as the discharge cone is not installed, something that can be done afterwards. On the contrary, if the centre of the partition is closed, the grates central ring must be held with through bolts. This is the only way to tighten easily the bolts by making possible to work simultaneously downwards and upwards. In the case of outlet partitions, through bolts—going from the chamber upwards up to the exterior of the outlet bottom—are a frequent solution.

The problem of non accessibility of the bolt nuts is frequent. It requires the use of through bolts, an expensive solution, for instance in the case of outlet bottoms.

Another possibility is offered by the patent EP-A-O 380 952 (CHR. Pfeiffer Maschinenfabrik GMBH). The bolt nut is blocked within a hexagonal hole as indicated in FIGS. 3 and 4 of the said patent.

The grates are located upwards—the direction of the flow of material being taken as reference. They carry openings, called slots, in order to enable the ground material and the air, if any, either to go from one chamber to the next one, or to leave the mill.

In order to accentuate the purpose of sieving, patent FR-A-2 122 251 (F. L. Smidth & CO.) develops the solution of a double sieve. The first one—thicker—is there to prevent the balls from leaving the chamber upwards while the second one—thinner and having smaller openings—screens the material. This second sieve can be made out of a simple existing perforated sheet of steel since it is not struck by the grinding media.

Either grates or backside plates shall be installed on the downward side of the partition. The backside plates are full, that is without slots. The centre of the partition is open in order to enable the material and the possible air to go through it.

In the case of outlet diaphragms, the downward side is made by the outlet bottom of the mill. There is neither grates nor backside plates on that side. The material also leaves through the centre of the partition.

These grates and backside plates must be manufactured in an alloy that is highly wear- and shock-resistant. They are also wear-elements that have to be regularly replaced.

The frame is not meant to be replaced so frequently. The frame of the intermediate partition, generally located at the third of the mill centre line, meets mechanical constraints that makes necessary to replace it but at less frequent intervals than the grates. The frame of the outlet partition is practically an element of the mill shell or of the outlet bottom. The mechanical constraints are almost non-existent at that location. It must, in most cases, not be renewed. It is important to keep in mind that the partition frames are not standardised. Each mill manufacturer sets its own rules. A high number of different partition frames exist for identical mill diameters.

Regarding the grates, the state of the art offers the following alternative: (1) grates in rolled steel and (2) grates in cast steel.

The grates in rolled steel offer the advantage of making adaptations inexpensive while the wear resistance is their weak point. The sheets are flame cut and the holes are machine drilled. As a consequence, the shape of the pieces as well as the way they are divided in several rows can easily be adapted to the shape of the frame.

From the point of view of wear, the rolled steel grates offer many disadvantages. (1) The choice of alloys that can be flame cut and machine manufactured is relatively small and determined by the steel manufacturers. A precise adaptation of the alloy to each case is not possible. (2) The hardness of the pieces is not uniform: the surface is harder and offers a higher wear resistance than the core of the grate. The speed at which the piece wears out is therefore exponential and to increase its thickness does not proportionally lengthen its life. The reason why the hardness varies is the following: the flame cutting prevents from using additional elements such as chromium, vanadium or molybdenum since the latter are non-inflammable. The pieces lack chromiumcarbons. As a consequence, they are sensible to the speed at which the piece cools down. Since the core of the piece cools down slowly, the structure of the alloy at that location changes again to the detriment of the hardness. (3) Moreover the heat treatment includes one quenching only. (4) Since the sheets, of which the pieces are made, are flat, it is impossible to add extra thickness at some places.

The cast grates are highly wear resistant while costly to adapt. Foundry patterns are expensive and are economically justifiable only providing they can be depreciated on a reasonably high number of pieces. In the present state of the art, the variety of partitions frames makes necessary to create new patterns for each case. The cost of cast grates is therefore significantly higher.

From the wear point of view, cast grates offer significant advantages. (1) The alloys can be adapted to each case at low cost. (2) The same is true for heat treatments. Chromium alloys make possible to have several quenchings and temperings which improve their hardness and impact strength. (3) The manufacturing process enables to have an uniform hardness: the surface hardness and the core hardness are identical. Cast alloys allow the use of additional elements such as chromium, vanadium or molybdenum which create chromiumcarbons. These are extremely hard and they appear at low temperature which means that they stay also at low temperature. As a consequence, even if the quenching does not cool the surface in the same way as the core and if, accordingly, the core cools down at a slower pace, the chromiumcarbons do not change their structure. Any increase in the thickness of the piece will lengthen its lifetime proportionally. (4) The very process of casting easily enables to add extra thickness to some parts of the pieces. They offer the advantage to wear out first. As long as they last, they significantly reduce the friction between the grinding media and the material and the surface of the cast pieces. The lifetime of the latter is importantly increased.

For cement without additives and as a rule, cast grates will last 50% longer than grates in rolled steel.

There is sometimes an additional problem. Frames from some partitions manufacturers have a small number of blades and, therefore, of supports for the grates. The latter must have a large surface. To withstand torsional stresses, these grates must be relatively thick. This rules out the possibility of using grates in rolled steel: thick sheets are too expensive.

Cast grates are the sole possibility despite the problem mentioned hereabove, that is the cost of the patterns. Moreover the torsional stresses make necessary to keep a minimum thickness. The grates have to be replaced despite the fact that a relatively large quantity of steel is still there.

PURPOSE OF THE INVENTION

The present invention aims to propose a device to attach the grates or backside plates on the partition frame of a tube mill, the said device being a support plate made in such a way that, for a given diameter, the same grates or backside plates could be used on all kinds of frames existing for that diameter.

It enables to use the same grates on intermediate and outlet partitions.

As a consequence, fixed costs can be depreciated on a large number of copies. Due to process requirements, the sole difference between intermediate and outlet partitions is the size of the slots. However, slots sizes can be modified by using different cores. It is easy to make them compatible with the same pattern so that the latter should not be changed.

This combines the advantages of the cast and rolled grates which, so far, were conflicting, that is advantageous manufacturing costs and the best possible wear resistance.

The device also enables to use grates having a normal thickness with frames offering a small number of blades.

In such a case, the thickness of the support plate, subject of the invention, can be calculated so that it could meet the torsional stresses. As a consequence, standard cast grates can be installed and let in the mill up to the maximum wear of their thickness. A waste of steel is avoided. Standard grates are indeed smaller which allows them to resist better to torsional stresses: as a rule it can be said that if the largest dimension of a grate is reduced by a proportion of 2, the thickness can be reduced by a proportion of 4.

Advantageously, the device does not alter in any way the original frame on which it is placed.

An additional system solves the problem of the tightening of the bolts when the bolt nut used to hold the grates becomes inaccessible due to the installation of the said grates. The said nut is located between the frame and the outlet bottom of the mill. The said additional system can be used whenever the nut is inaccessible or difficult to reach.

MAIN CHARACTERISTIC ELEMENTS OF THE INVENTION

The present invention relates to a device—called support plate—that is installed between the wear pieces of the partition of a tube mill—grates or backside plates—and the frame of the same partition and that, for a given diameter, enables to use identical wear pieces irrespective of the differences in the design of the said frame.

The support plate is installed on the frame once the wear pieces of the partition have been removed. The support plate is made of a perforated flame cut sheet metal. It is attached to the frame through bolts or welding if the frame is not cast. The holes for holding the original wear pieces, whether through holes or not, are used for the bolts necessary to fix the support plate to the frame. The fact that the support plate is perforated makes possible to keep a free access to the bolt nuts.

The support plate is divided into sections so that it can easily enter into the mill. Once they are set in position, these sections are welded together so that one single plate is made.

The support plate is provided with holes for the bolts required to hold the wear pieces of the partition. The position of the said holes is always identical for a given diameter so that for that diameter, the same wear pieces can be used.

Contrary to the device of the invention, in the systems proposed by patents FR-A-2 345 213 (Polysius AG) and WO-A-95 09906 (Slegten s.a.), wear pieces—grates and backside plates—are directly attached to the frame of the partition. This means that the holes in the wear pieces and the holes in the frame must perfectly correspond. In the device of the invention, there is an intermediate element or interface between the said wear pieces and the frame. The wear pieces are attached to the device of the invention, the latter being attached through other means to the frame.

In the case of the invention, the holes for holding the wear pieces do not correspond any more to the original holes. Consequently, in the case of an outlet partition, the use of through bolts that go through the mill outlet bottom is not possible any longer.

Drilling new holes is neither technically nor economically feasible.

As explained earlier, the lack of through bolts is not a problem for the external ring of the grates.

For the central ring, a problem can arise, should the nuts becomes inaccessible when the wear pieces of the partition are installed.

This is why the device of the invention offers an additional solution to that problem.

Should the bolt nuts for holding the wear pieces become inaccessible, the support plate can be provided with a system that enables to install the nuts at any time, therefore when they are still easily accessible. The said system keeps the bolt nuts in a hole and prevents them from rotating, namely when the bolt screw is tightened.

The said system is made of a rubber piece the external shape of which is square. That piece is installed in a hole having the same square shape. The said hole is made of four plates welded together or of a section of a square tube. It is centred on the hole for the bolt. Due to the elasticity of the rubber, the nominal external perimeter of that piece can be slightly larger than the internal perimeter of the hole while being still easy to introduce in the said hole. As a consequence, once installed inside the said hole, the said piece of rubber is caught in. The external shape of the piece in rubber is such that is amplifies the effect of tightening.

That piece in rubber is perforated at its centre. The shape of that central perforation is hexagonal and its internal perimeter is slightly smaller than the external perimeter of the bolt nut. Once pushed in place, the nut is adequately caught in. It cannot turn any longer and the conical washers—that are crimped on the nut on the side of the frame and the diameter of which is larger than the diameter of the hole—prevent the nut from being pushed out of the piece in rubber due to the pressure of the screw.

As a consequence, the bolt screw can be tightened without having to intervene on the side of the nut in order to maintain it in the hole or to prevent it from rotating.

Other systems exist in order to hold the nut but they are not reliable. In most cases, the nut is prevented from rotating by a rectangular hole in metal similar to the one described hereabove. Since the metal is not ductile, wide tolerances have to be provided in order to make possible an adjustment of the location of the nut when it needs to be put in line with the screw at the time of the assembling. When tightening, the existence of this tolerance and of the gap that goes along with it, will make easier for the nut to rotate within the hole. The applied torque load is so big that it will often blunt the tips of the hexagonal nut which will then be able to rotate within the rectangle. This will prevent a proper tightening.

Other systems such as the one proposed by patent EP-A-O 380 952 (CHR. PFEIFFER MASCHINENFABRIK GMBH.), provide a perfect wedging of the nut. Contrary to the device of the invention, no adjustment of the location of the nut remains possible at the time of the assembling. This makes the assembling specially complicated and therefore expensive.

According to the device of the invention, the hexagonal nut is advantageously caught within an hexagon without tolerances. The hexagon since it fully tightens the surface, will prevent any rotation more efficiently than what could be achieved by a rectangle tightening a hexagon. Similarly, the external shape of the piece in rubber is a square tightened within a square.

The elasticity of the rubber is such that despite the absence of tolerance, it remains possible to deform it in order to put the nut in line with the screw.

If necessary, the said rubber will be chosen in order to be able to withstand high temperatures. Rubber is also advantageously suitable for the wet process.

Therefore, the support plate can be used for every existing situation. The standardisation of wear pieces of partitions made in cast alloy makes possible to have the best possible system against the wear, while reducing the manufacturing costs significantly by enabling the depreciation of the foundry patterns on large series.

With such a system, the only variable is the support plate which is flame cut. Computerised systems enables to link directly the design with the flame cutting machines so that individualised pieces can be done at low cost. Consequently, the necessity to adapt the support plate to each case does not increase significantly the total cost.

Patent FR-A-2 122 251 (F. L. Smidth & Co.) mentions the addition of a simple perforated plate. However, the said perforated plate fulfils a completely different function than the invention. It aims at creating a double sieving system in order to improve the sieving function of a partition. It does not aim at facilitating the holding of the wear pieces. Contrary to the invention, the latter are directly bolted on the frame. The holes in the frame, the perforated plates and the wear pieces must be aligned. That is precisely what the present invention aims at avoiding.

The said support plate makes also possible to use grates having a normal size and therefore a normal thickness, even when the original frame offers a small number of support blades. The thickness of the support plate can be calculated in order to be able to meet torsional stresses.

DESCRIPTION OF A PREFERRED EMBODIMENT OF THE PRESENT INVENTION

Figure 1B:
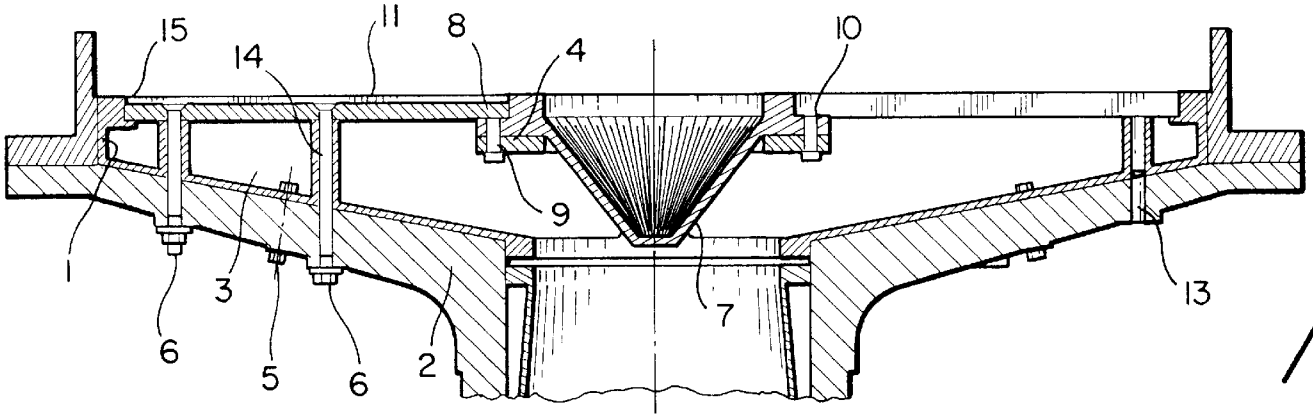
FIGS. 1A and 1B show a typical outlet partition for a tube mill. The figures show half a partition, the FIG. 1B showing a cross section and the FIG. 1A, a front view. The lower part of FIG. 1A shows the original grates while the upper part of FIG. 1A shows how the partition looks when the grates have been removed.
Figure 1A:
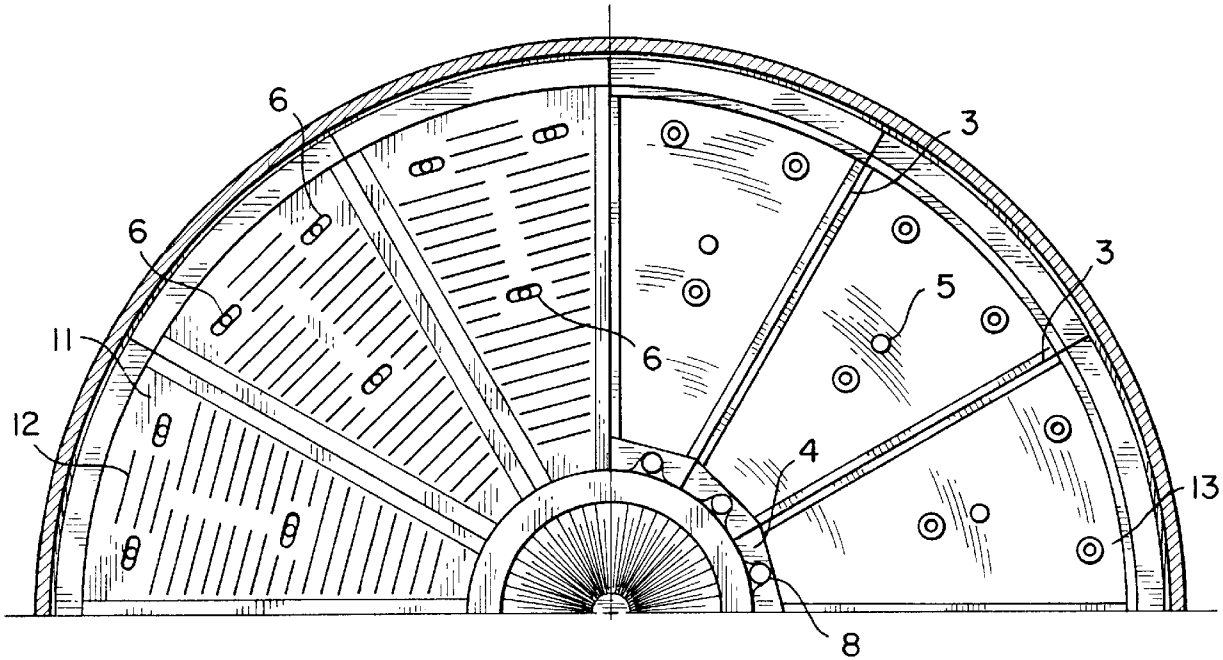
Figure 2B:
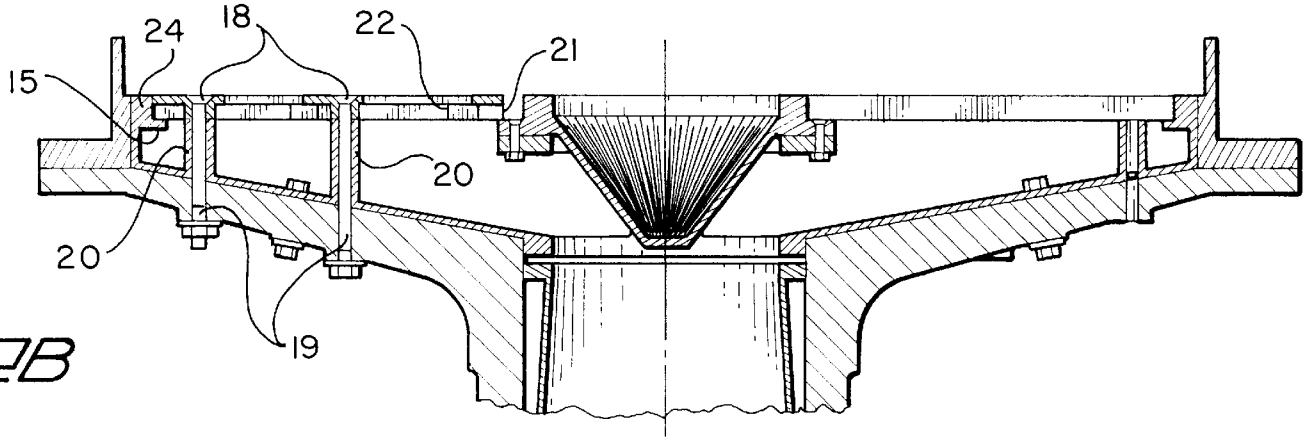
FIGS. 2A and 2B are similar to FIGS. 1A and 1B except that the lower part of FIG. 2A shows the frame covered with the support plate, subject of the present invention.
Figure 2A:
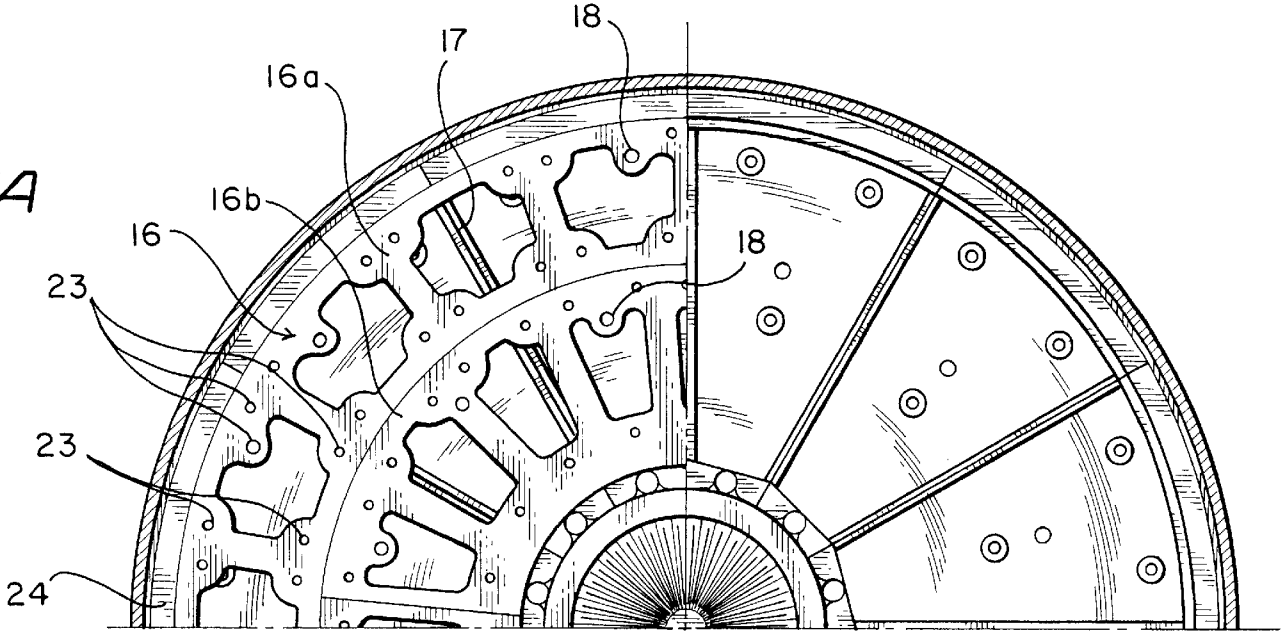

The holding device described thereunder relates to an outlet partition for a four meter diameter tube mill.

The said partition includes a frame. The latter is made of a plate (1) that rests on the mill bottom (2) and of lifters (3) made of radial blades welded on the said plate (1), the said blades extending from the periphery of the partition up to the discharge cone (7).

At the centre of the partition, flat bars (4) are welded between the lifters (3) and perpendicularly to them. The bottom plate (1) is attached to the mill through short through bolts (5). The partition is maintained in position almost naturally through the thrust of the grinding load and of the material. The bolts holding the partition to the mill bottom meets therefore weak stresses and can be relatively light. In addition to these short through bolts (5), the bolts holding the grates (6) contribute to the holding of the partition.

A truncated cone, called discharge cone (7), rests on the flat bars between the lifters (4). The said cone is provided with eyelets (8) through which the bolt screws can pass in order to hold it to the flat bars (4). The head of the screws (10) are protected by the grates (11) described hereafter.

The vertex of the cone is on the side of the mill outlet. It contributes to the evacuation of the material out of the mill. The material enters into the partition through the slots. It is lifted by the lifters following the rotation of the mill. At the top of the rotation, the material falls down onto the cone which diverts it towards the outlet trunion.

Grates (11) are placed against the frame. They are provided with openings called "slots" (12). The material enters into the partition through the said slots. The latter also enables the passage of the air when required to ventilate the mill. Each of these grates is held with three through bolts (6) going through the holes (13) in the plate (1) which must correspond to the holes (2) in the mill bottom. Struts (14) protect the through bolts. With the flat bars (4) and a peripheral shoulder (15), the said struts (14) contribute to keep the grates (11) at an adequate distance from the mill outlet (2).

In order to install the device, subject of the present invention, the grates (11) are dismantled. The frame is bare as shown by half of the FIGS. (1) and (2). The perforated support plate, object of the present invention (16), is set on the edge of the lifters (17) and is, therefore, perpendicular to the mill axis. In order to facilitate the introduction into the mill, the said plate is divided in four sections: two peripheral rings, each of them being a semi-circle (16*a*) and two central rings, each of them being also a semi-circle (16*b*). These sections are welded together in order to constitute one single piece.

The support plate is perforated in order not to block the slots (12) and to leave a free passage for the material and possibly the air. The plate is provided with eyelets (18) corresponding to the existing holes for holding the original grates. As a consequence, through bolts (19) going through the mill bottom can easily hold the said plate onto the frame. In the case shown on the figures, the number of bolts that are required to hold the plate efficiently are inferior to the number of existing holes. New struts, longer than the original ones (20), protect the through bolts (19) and, with the lifters (3), they provide a support for the plate.

In the case shown on the figures, the support plate is provided with a ring, welded perpendicularly to its plane (21). The said ring (21) and the struts (20) keep the support plate removed from the peripheral shoulder (15) and the central flat bar (4) in between which the original grates were installed. There are two reasons for doing so. First, one avoids to have to cut the lifters (3) at the place where the square holes for the nuts (22) will be. The said holes are necessary to maintain the nuts of the bolts used to hold the grates. They are described thereunder. Secondly, one suppresses the need for fixed dimensions of the grates that such an embedding system involves and which would prevent the use of standardised grates.

The support plate (16) is provided with holes (23) in order to attach the grates.

The support plate (16) does not modify the existing system for holding the discharge cone by the bolts indicated in (9).

In the considered case, the foot of the partition (24) is protected by mill liners. In other cases, if the mill liners do not offer sufficient protection, a plain ring is installed against the said foot, externally to the grates peripheral ring (26).

The grates peripheral ring (26) are held on the support plate by bolts (27) that are not through bolts. The nut of the said bolts is kept in position by using the system described thereunder that enables to avoid any manual holding on the side of the outlet bottom (2).

Once the peripheral ring is installed, the grates of the central ring (28) are attached following the same system.

The standard shape of the grates of the central ring includes a groove (29). When the said grates are used on the intermediate partition, a flange is inserted in that groove. The central air screen is bolted on that flange.

Figure 3B:
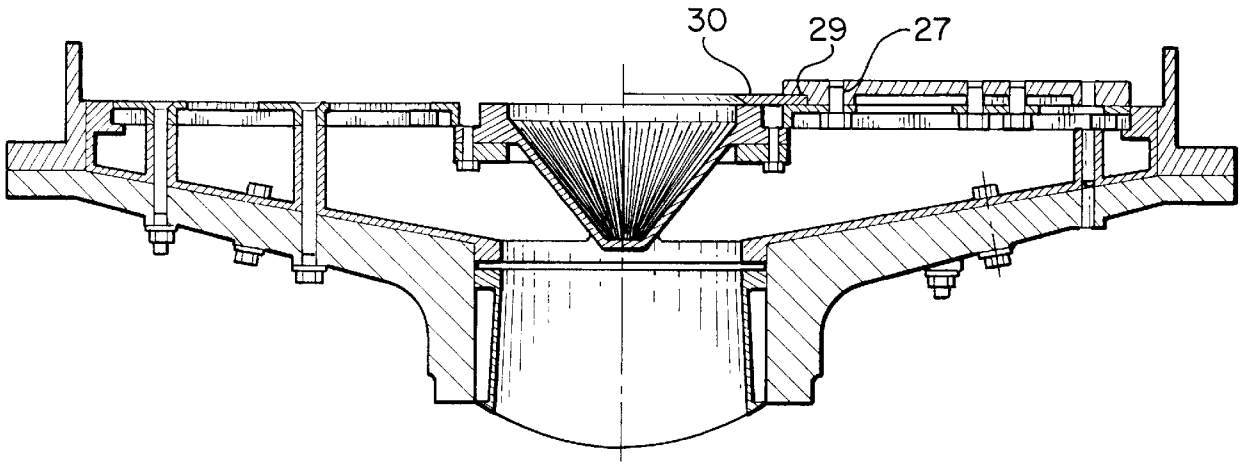
FIGS. 3A and 3B are similar to FIGS. 2A and 2B. The partition is fully covered with the support plate, the upper part of FIG. 2A being shown with standard grates in cast alloy.
Figure 3A:
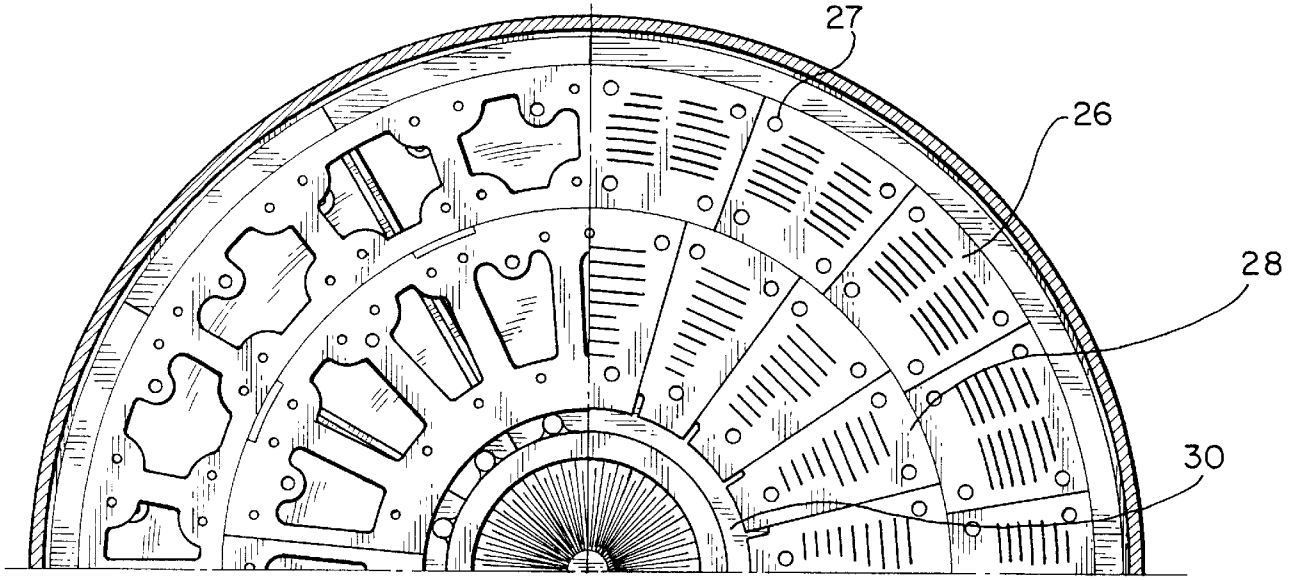

According to the preferred embodiment shown in FIG. 3, the said groove is used to hold a central protection ring (30), made out of a flame cut sheet metal. The said central ring is divided into two parts. Each part is introduced in the groove. Once introduced, both parts are welded together.

Figure 4B:
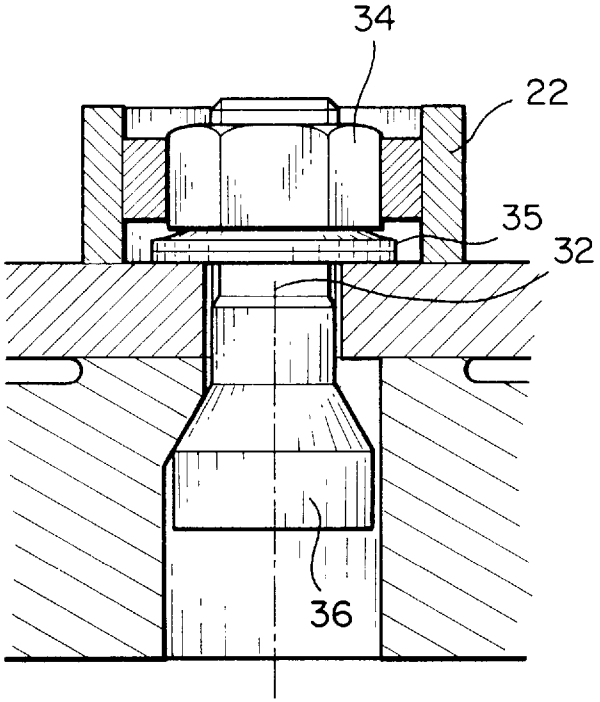
FIGS. 4A and 4B show the system to hold the nuts that, when necessary, enables tightening the bolts without having to act on the side of the outlet bottom.
Figure 4A:
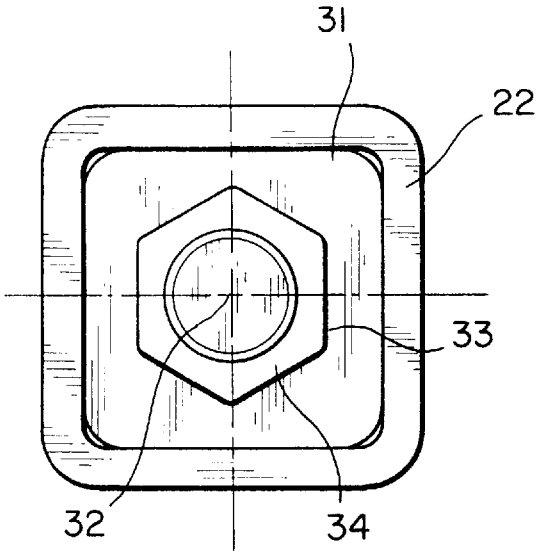

The system of not through bolts (27) is shown in FIG. 4. It is made of a piece in rubber of which the external shape is square (31). That piece is installed in a hole showing also a square shape (22). That hole is made of four plates welded together or of a cut square tube. It is centred on the bolt hole (32). Due to the elasticity of the rubber, the external perimeter of the rubber piece can be slightly superior to the internal diameter of the hole, while remaining relatively easy to introduce. As a consequence, the piece in rubber is caught within the hole. The external shape of the piece in rubber is such that it improves the tightening. The centre of the said piece in rubber is perforated. The said perforation (33) is hexagonal. Its internal perimeter is slightly smaller than the external perimeter of the bolt nut (34). As a consequence, once introduced, the said nut is properly caught in. It will not be able to rotate and the conical washers (35)—that are crimped on the nut on the side of the frame and the diameter of which is larger than the diameter of the hole—prevent the nut from being pushed out of the piece in rubber due to the pressure of the screw (36).

That way, the bolt screw can be tightened from the chamber upwards, without any intervention on the downward side in order to prevent the nut from rotating and from leaving the hole.

Another advantage is that the rubber does not corrode and therefore is perfectly suitable for the wet process.

Due to the invention, the partition is advantageously equipped with two grates rings that are fully standard grates for the considered mill diameter while neither the original frame nor the existing system used to hold the grates and the frame onto the outlet bottom have to be modified. The problem of non-accessibility to the bolt nuts is also advantageously solved.

It is quite obvious that the present description is related to one possible embodiment only of the invention. Other embodiments remains possible in order to be able to fit each existing frame.

We claim:

1. Device for holding grates or backside plates in a partition of a tube mill, the partition being made of a frame, that is flame cut or cast, in steel or iron, the frame being provided with anchor holes, the holding device comprising:

a perforated plate including perforations enabling free access to bolt nuts holding the perforated plate on the partition frame and extending perpendicular to a mill axis, the perforated plate being provided with anchor holes for the grates or backside plates, the holes being, for a given diameter, always identically positioned so that for the given diameter, the grates or backside plates can always be used irrespective of the shape of the partition frame, said perforated plate also including holes or eyelets for attaching the perforated plate to the frame, said holes or eyelets being positioned to correspond to the anchor holes provided in the frame.

2. Device according to claim 1, wherein the perforated plate is flame cut.

3. Device according to claim 1, wherein the perforated plate includes a device to hold the grates or backside plates, the device being a piece of rubber of which an external shape is square and which has in its centre a hole an internal shape of which is hexagonal, a nominal external perimeter of the device being slightly superior to an internal perimeter of the hole in which it is installed, the hole being centred on holes of bolts and being made out of four plates welded together or of a section of a square tube, so that once the piece of rubber is introduced, it is caught within the hole due to its elastic properties, and the perimeter of the hexagonal hole in its centre being slightly inferior to the external perimeter of the bolt nut so that the bolt nut is caught in the device due to the elasticity of the rubber.

4. Device according to claim 3, wherein conical washers are crimped on the bolt nut.

5. Device according to claim 1, wherein the perforated plate is attached to the frame of an intermediate partition dividing a tube mill in different chambers.

* * * * *